US008449216B2

(12) United States Patent
Vrondran et al.

(10) Patent No.: US 8,449,216 B2
(45) Date of Patent: May 28, 2013

(54) MANHOLE COVER SAFETY DEVICE

(75) Inventors: Kevin S. Vrondran, East Jordan, MI (US); Scott B. Beal, East Jordan, MI (US); David E. Fuller, Ellsworth, MI (US); Dennis E. Webb, East Jordan, MI (US); Jeremy I. Johnson, East Jordan, MI (US)

(73) Assignee: East Jordan Iron Works, Inc., East Jordan, MI (US)

( * ) Notice: Subject to any disclaimer, the term of this patent is extended or adjusted under 35 U.S.C. 154(b) by 0 days.

(21) Appl. No.: 13/236,823

(22) Filed: Sep. 20, 2011

(65) Prior Publication Data

US 2013/0071183 A1 Mar. 21, 2013

(51) Int. Cl.
*E02D 29/14* (2006.01)

(52) U.S. Cl.
USPC ..... 404/25; 52/19; 49/49

(58) Field of Classification Search
CPC ..... E02D 29/14
USPC ..... 404/25, 26; 52/19, 20; 49/49
See application file for complete search history.

(56) References Cited

U.S. PATENT DOCUMENTS

| | | | | |
|---|---|---|---|---|
| 5,507,590 | A * | 4/1996 | Argandona | 404/25 |
| 5,788,406 | A * | 8/1998 | Hernandez | 404/25 |
| 5,950,368 | A * | 9/1999 | Bradford | 52/20 |
| 8,256,164 | B2 * | 9/2012 | Cuccurullo | 52/20 |
| 2009/0257823 | A1 * | 10/2009 | Christensen | 404/25 |
| 2011/0222964 | A1 * | 9/2011 | Lacroix | 404/26 |

* cited by examiner

*Primary Examiner* — Raymond W Addie
(74) *Attorney, Agent, or Firm* — Warner Norcross & Judd LLP

(57) ABSTRACT

A manhole cover assembly includes a frame that includes a central opening and a safety stop portion, and a cover hingedly attached to the frame such that the cover is pivotable between a closed position covering the central opening and an open position providing access to the central opening. A safety device is connected to the frame and the cover for locking the cover in the open position. Movement of the cover to the open position automatically moves the safety device to a locked position in which said safety device engages the safety stop portion and prevents movement of the cover to the closed position. When the cover is open, the safety device is manually movable between the locked position and an unlocked position in which the safety device is disengaged from the safety stop and permits movement of the cover to the closed position.

19 Claims, 5 Drawing Sheets

MANHOLE COVER SAFETY DEVICE

BACKGROUND OF THE INVENTION

The present invention relates to manhole covers and other covers for access openings, and more particularly to a safety device that can be attached to a cover to lock the cover in an open position.

Manhole covers are well known. Generally, a manhole cover is a removable plate forming the lid over the opening of a manhole to, among other things, prevent someone from falling in and to keep unauthorized persons out. Manhole covers often weigh more than 100 pounds, partly because the weight keeps them in place when traffic passes over them, and partly because they are often made out of cast iron, sometimes with infills of concrete. This makes them inexpensive and strong, but heavy.

Because of the weight of manhole covers, they often feature lift assemblies to assist users in opening and closing the covers. For instance, they may include a spring-assisted or gas-assisted cylinder connected between the cover and the frame to make them easier to open. As an added feature, some manhole covers, both manual and lift-assisted, include hinges on the frame and the cover to allow the cover to pivot between a closed position covering the manhole access opening, and an open position providing access to the manhole opening.

As an added safety feature to prevent a hinged manhole cover from swinging closed, it is known to provide a locking mechanism that holds the cover in the open position. Such locking mechanisms are generally formed integrally with the hinge assembly of the cover. For instance, the hinge assembly may include a pair of tabs extending from the cover, and a pair of slots or tabs on the frame. The cover can be moved between an open and closed position by rotating the tabs within the slots or about the posts. One of the slots or posts may be specifically shaped to enable the cover to move from the closed position to the open position, and to prevent movement of the cover from the open position to the closed position. For instance, one of the slots may include a flat surface that engages the cover tab when the cover is opened to prevent the cover from being closed. In order to move the cover to the closed position, a user must lift up on the cover to disengage the cover from the flat surface, and then rotate the cover to the closed position.

Unfortunately, cover locking mechanisms suffer from a number of drawbacks. For instance, over time, dirt and other debris may collect in the areas of the hinges and prevent the locking mechanism from working properly. In addition, the typical locking mechanism must be added to the cover at the time that the cover is formed. As a result, converting a non-locking manhole cover to a locking manhole cover can require replacement of the entire cover, and in some cases replacement of both the cover and frame. In many cases, replacement is cost prohibitive and requires disposal of the otherwise functional non-locking cover.

SUMMARY OF THE INVENTION

The present invention provides a manhole cover assembly that includes a safety device. The safety device includes a safety bar that automatically moves when the cover reaches an open position to prevent the cover from being closed. Subsequent manual movement of the safety bar permits the cover to be moved back to the closed position.

In one embodiment, the manhole cover assembly includes a frame and a cover hingedly attached to the frame such that the cover is pivotable between a closed position covering the access opening and an open position providing access to the access opening. The safety device may be a safety bar connected to the frame and the cover. Movement of the cover to the open position may automatically move the safety bar to a locked position in which the safety bar engages the frame and prevents movement of the cover to the closed position. The safety bar may be manually movable when the cover is in the open position between the locked position and an unlocked position in which the safety bar is disengaged from the frame and permits the cover to move to the closed position.

In one embodiment, the frame includes a pivot post extending from the frame wall, and the safety bar includes a slot that receives the pivot post. In one embodiment, the post translates within the slot when the safety bar is moved between the locked position and the unlocked position. The slot may include a first portion and a second portion extending at an angle from the first portion, and the post may automatically translate within the first portion when the cover is moved to the open position. Manual movement of the safety bar when the cover is in the open position may move the post from the first portion of the slot to the second portion of the slot. The post may automatically translate back into the first portion when the cover reaches the closed position.

In one embodiment, the safety bar includes a rear edge that engages a safety stop portion on the frame when the safety bar is in the locked position. The safety stop portion projects inwardly from the frame wall. The rear edge is disengaged from the safety stop when the safety bar is moved to the unlocked position to permit movement of the cover back to the closed position. The positioning of the slot with respect to the rear edge, and the positioning of the safety stop with respect to the frame wall, may be configured to control the position of the cover in which the safety bar moves to the locked position.

The safety device of the present invention may be installed on new manhole cover assemblies as they are manufactured, or may be retrofitted to existing assemblies by adding the safety bar, safety stop and safety pivot post to the existing manhole cover assembly. The present invention thus provides an efficient method for locking the cover in an open position. These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT

I. Overview

Figure 1:
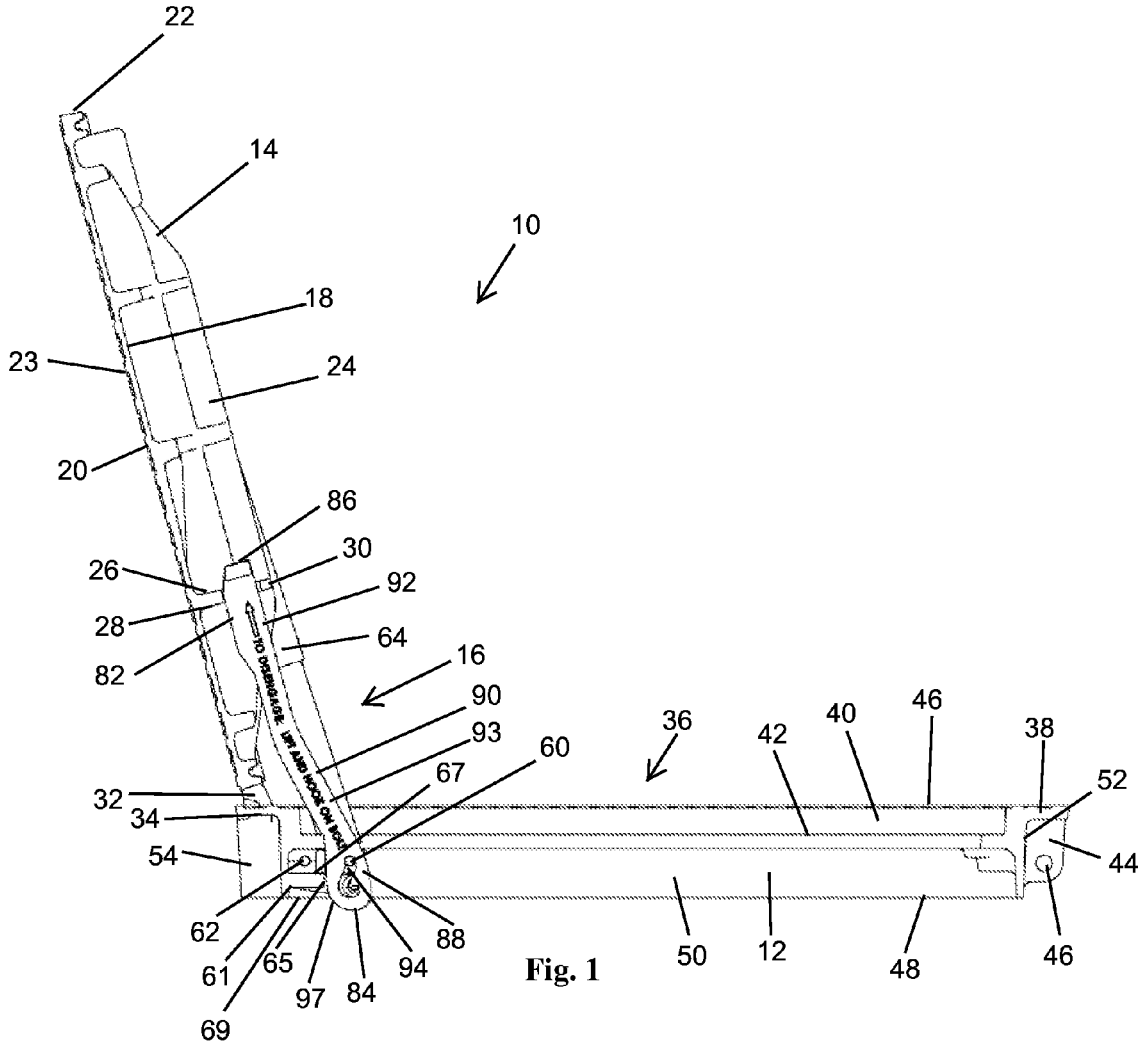
FIG. 1 is a side cross-sectional view of a manhole cover including a safety device according to one embodiment of the present invention, wherein the cover is in a fully open position.

A manhole cover assembly including a safety device according to one embodiment of the present invention is shown in FIGS. 1-5 and generally designated 10. In one embodiment, the assembly 10 includes a frame 12, a cover 14 and a safety device 16 attached to the cover 14 and the frame 12. The safety device 16 moves from a first position to a second position when the cover is opened, and prevents the cover from being closed until the safety device 16 is manually moved back to the first position.

II. Structure

The cover 14 is generally a cast iron cover of an overall square, rectangular or disc shaped geometry. In other embodiments, the cover 14 could be of another geometry, and another material. In one embodiment, the entire cover 14 is formed from one material, and includes a lower face 18, an upper face 20 opposite the lower face, a circumferential edge 22 and a central portion 23 generally near the center of the disc shaped cover 14. The cover defines a thickness between the upper face 20 and the lower face 18. In one embodiment, the upper face 20 may include projections and designs that provide a grip surface, and that indicate the owner of the cover 14, the manufacturer, the type of infrastructure underneath the cover, or any other pattern. The lower face 18 may include support ribs 24 extending therefrom that provide structural strength to the cover 14. In the illustrated embodiment, a retaining loop 26 extends from the lower face 18 of the cover 14. In one embodiment, the retaining loop 26 may be a full loop formed by a pair of arms 28 joined together by a bridge section 30. Alternatively, the retaining loop may be formed by a single arm 28, and a bar that is cantilevered to the arm 28 and extends at an angle from the arm 28 (in a manner similar to the bridge section 30). The cover further includes mounting tabs 32 extending from the circumferential edge 22. The mounting tabs 32 include structure that enables the hinged attachment of the cover 14 to the frame 12. In one embodiment, the cover 14 includes a pair of mounting tabs 32, each mounting tab 32 including a recess 34 configured to receive a mounting post (not shown) extending from the frame 12, such that the recesses 34 and cover 14 are capable of pivoting about the mounting posts between an open position and a closed position.

The frame 12 is generally supported on a substructure (not shown) that houses infrastructure to which the manhole cover assembly 10 provides access. The frame 12 is generally a peripheral frame 12 defining a central opening 36 of sufficient size to permit access to the underlying infrastructure. In the illustrated embodiment, the frame 12 includes a support flange 38, a frame wall 40 and a cover support rim 42. The frame geometry is typically configured to match the geometry of the cover 14, such that the cover 14 fits closely within the frame wall 40. For example, in the case of a generally square cover 14, the frame 12 forms a generally square periphery.

The frame 12 may be mounted to the substructure in any suitable manner, including essentially any conventional mounting construction. Accordingly, the substructure and installation of the frame 12 will not be described in detail. Suffice it to say that the support flange 38 may be mounted to the substructure housing the infrastructure to be maintained or directly to the infrastructure itself. In the illustrated embodiment, the flange 38 is an annular rim, but the flange could alternatively have any geometry adapted for connection to a particular substructure. The flange 38 may include mounting holes, slots, tabs brackets or any other means for attachment to a substructure. In the illustrated embodiment, an attachment rib 44 extends from the frame wall 40 to the flange 38 to provide an additional option for attaching the frame 12 to a substructure. The rib 44 includes a hole 46 for connection to the substructure.

In the embodiment depicted in the figures, the frame wall 40 includes as first end 46, a second end 48, an interior surface 50 and an exterior surface 52. The first end 46 abuts the flange 38. The frame wall 40 extends away from the flange 38 at approximately a ninety degree angle. In other embodiments, the frame wall 40 could extend at another angle with respect to the flange, and the flange 38 could extend from another position on the frame wall 40. The interior surface 50 of the frame wall 40 faces toward the interior opening 36 of the frame 12.

The cover support rim 42 is adapted to receive and support the cover 14. In one embodiment, the cover support rim 42 projects inwardly from the interior surface 50 of the frame wall 40. As illustrated, the cover support rim 42 is a generally annular ring extending parallel to the plane of the support flange 38. The cover support rim 42 need not extend parallel to the plane of the support flange 38. For example, the cover support rim 42 may extend at an angle to the flange 38 to compensate for an angled substructure or to provide an angled cover 14. As illustrated, the cover support rim 42 extends around the entire circumference of the frame wall 40; however, in an alternative embodiment, the cover support rim 42 may include multiple discrete segments extending from the interior surface 50 of the frame wall 40.

The frame 12 includes structure for attaching to the cover 14, such that the cover 14 is capable of pivoting with respect to the frame 12 between a closed position (shown in FIG. 2) and an open position (shown in FIG. 1). In the illustrated embodiment, the frame 12 includes one or more frame extensions 54 extending from the frame wall 40 for receiving the one or more mounting tabs 32 on the cover 14. Although not shown, the frame extensions may be U-shaped extensions formed integrally with the frame wall 40, each having an interior surface from which extends a cover mounting post. The cover mounting post may be a rod having a generally round cross section. In one embodiment, the mounting posts extend into the recesses 34 in the mounting tabs 34 on the cover 14, such that the mounting posts can pivot within the recesses. Alternate mounting methods may otherwise be used for hingedly connecting the cover 14 and frame 12 such that the cover 14 can pivot with respect to the frame 12.

In one embodiment, a safety pivot post 60 extends from the frame 12. As shown, an arm 62 projects inwardly from the interior surface 50 of the frame wall 40, and the safety pivot post 60 extends from the arm 62 such that the safety post is capable of supporting a safety device (described below). As shown, the safety pivot post 60 is a rod having generally circular cross section. The safety post 60 may be similar in size and shape to the cover mount posts described above. A safety stop 61 projects from the interior surface 50 of the frame wall 40 in alignment with the safety post 60. The safety stop 61 may be a discrete segment that extends from a portion of the frame wall 40 aligned with the safety pivot post 60. In one embodiment, the safety stop 61 is positioned below the cover support rim 42, and projects from the frame wall 40 about the same distance as the cover support rim 42. The safety stop 61 includes an upper surface 67 and a lower surface 69. As shown, the safety stop 61 includes a leading edge 65 that is angled with respect to the frame wall 40 such that the leading edge 65 at the upper surface 67 extends beyond the leading edge 65 at the lower surface 69.

The assembly 10 may additionally include a lift assist mechanism for assisting in raising the cover 14. As shown, the lift assist mechanism is a hydraulic or pneumatic cylinder 64 mounted to the frame 12 and cover 14. A first end 66 of the cylinder 64 is mounted to a lift assist arm 68 extending from the interior surface 50 of the frame wall 40, and a second end (not shown) of the cylinder 64 is mounted to the lower face 18 of the cover 14.

A safety device 16 is mounted between the frame 12 and cover 14 for preventing the cover 14 from closing when the cover is moved to the open position. In the illustrated embodiment, the safety device 16 includes a safety bar 82 having a first end 84 and a second end 86. The safety bar 82 may be formed from a variety of materials, including cast iron, steel, aluminum or molded plastic. In the illustrated embodiment, the safety bar 82 includes a longitudinal length extending between the first 84 and second 86 ends, and is slightly curved along the longitudinal length. In particular, the safety bar 82 of the illustrated embodiment includes a generally straight first portion 88 extending from the first end 84, a transition portion 90 that is angled with respect to the first portion 88, and a generally straight third portion 92 extending from the transition portion 90 to the second end 86. In one embodiment, the safety bar includes a front edge 93 and a rear edge 95. The rear edge 95 faces the lower face 18 of the cover 14 when the cover 14 is closed and/or the frame 12 when the cover 14 is open. The front edge 93 faces the central opening 36. As shown, the rear edge 95 of the safety bar 82 includes a generally flat surface 91 within the first portion 88 of the safety bar 82. The generally flat surface 91 transitions into a rounded corner 97 at the location where the rear edge 95 meets the first end 84.

Figure 6:
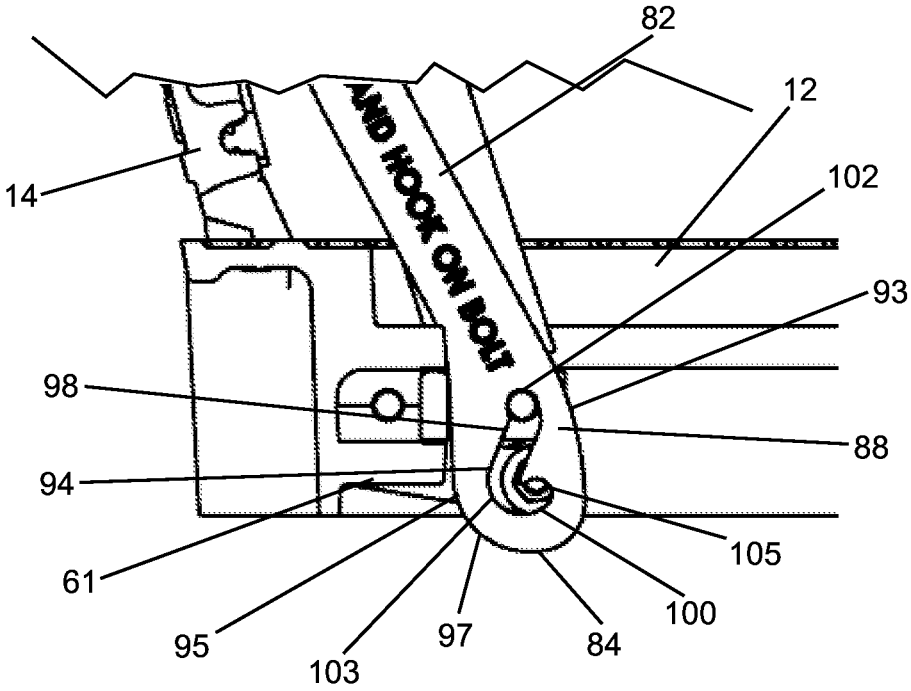
FIG. 6 is as close up view of a portion of the manhole cover of FIG. 1.

The safety bar 82 includes structure that enables the safety bar to engage the safety pivot post 60 and pivot with respect to the safety pivot post 60. In the illustrated embodiment, the safety bar 82 defines a slot 94 that receives the safety pivot post 60. The slot 94 is generally J-shaped, and positioned within the first portion 88 of the safety bar 82, proximate to the first end 84 of the safety bar 82. As shown in FIG. 6, the slot 94 includes a generally elongated portion 98, and a hook portion 100 extending transversely from the elongated portion 98 toward the front edge 93 of the safety bar 82. The elongated portion 98 includes an upper end 102 and a lower end 103 forming a junction between the elongated portion 98 and the hook portion 100. The hook portion 100 includes an end 105 opposite the elongated portion 100. As shown, the elongated portion 98 is angled with respect to the longitudinal length of the safety bar 82, such that the upper end 102 is closer to the front edge 93 than the lower end 103.

Figure 2:
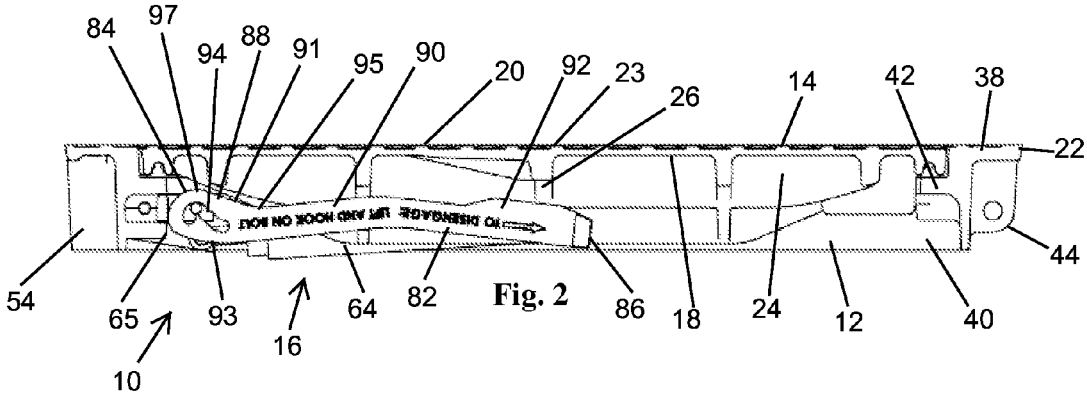
FIG. 2 is a side cross-sectional view of the manhole cover, wherein the cover is in a closed position.
Figure 3:
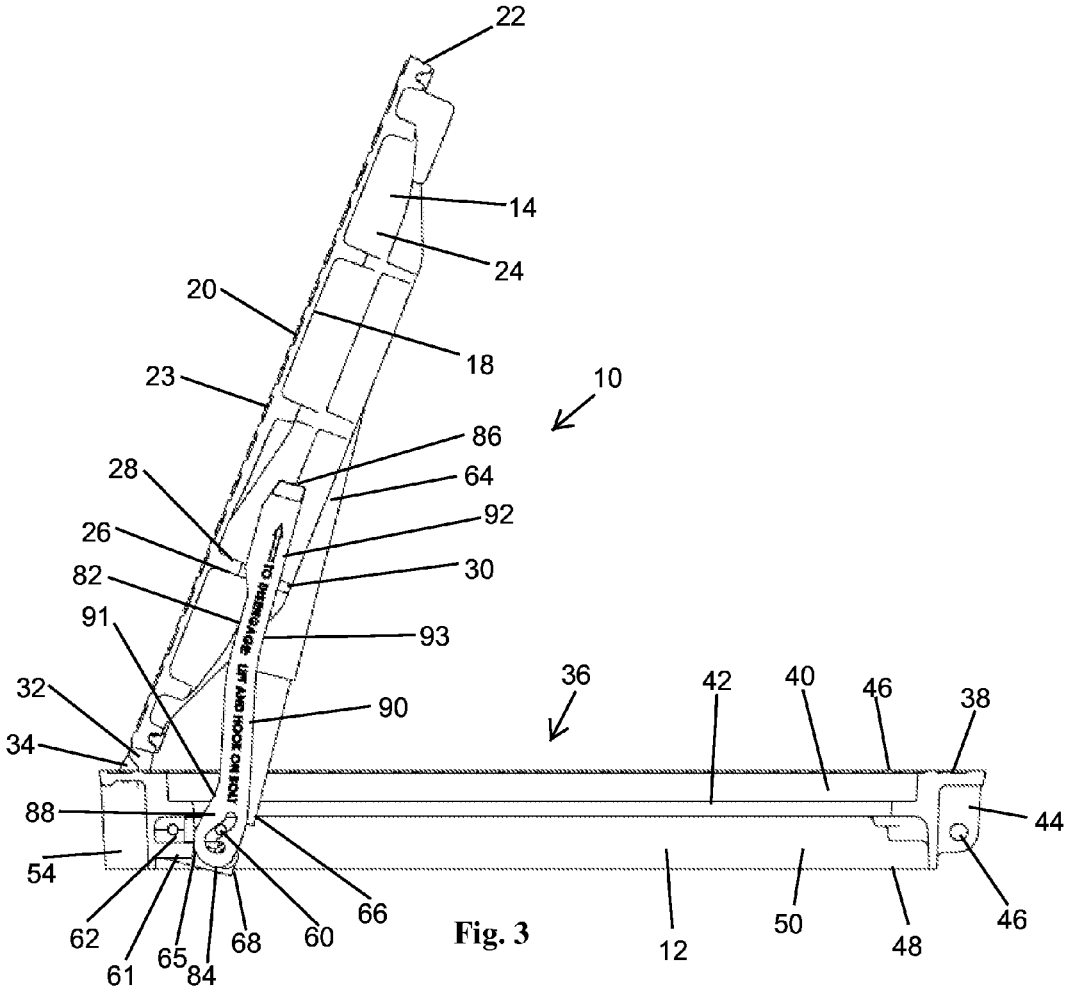
FIG. 3 is a side cross-sectional view of the manhole cover, wherein the cover is in a partially open position.
Figure 4:
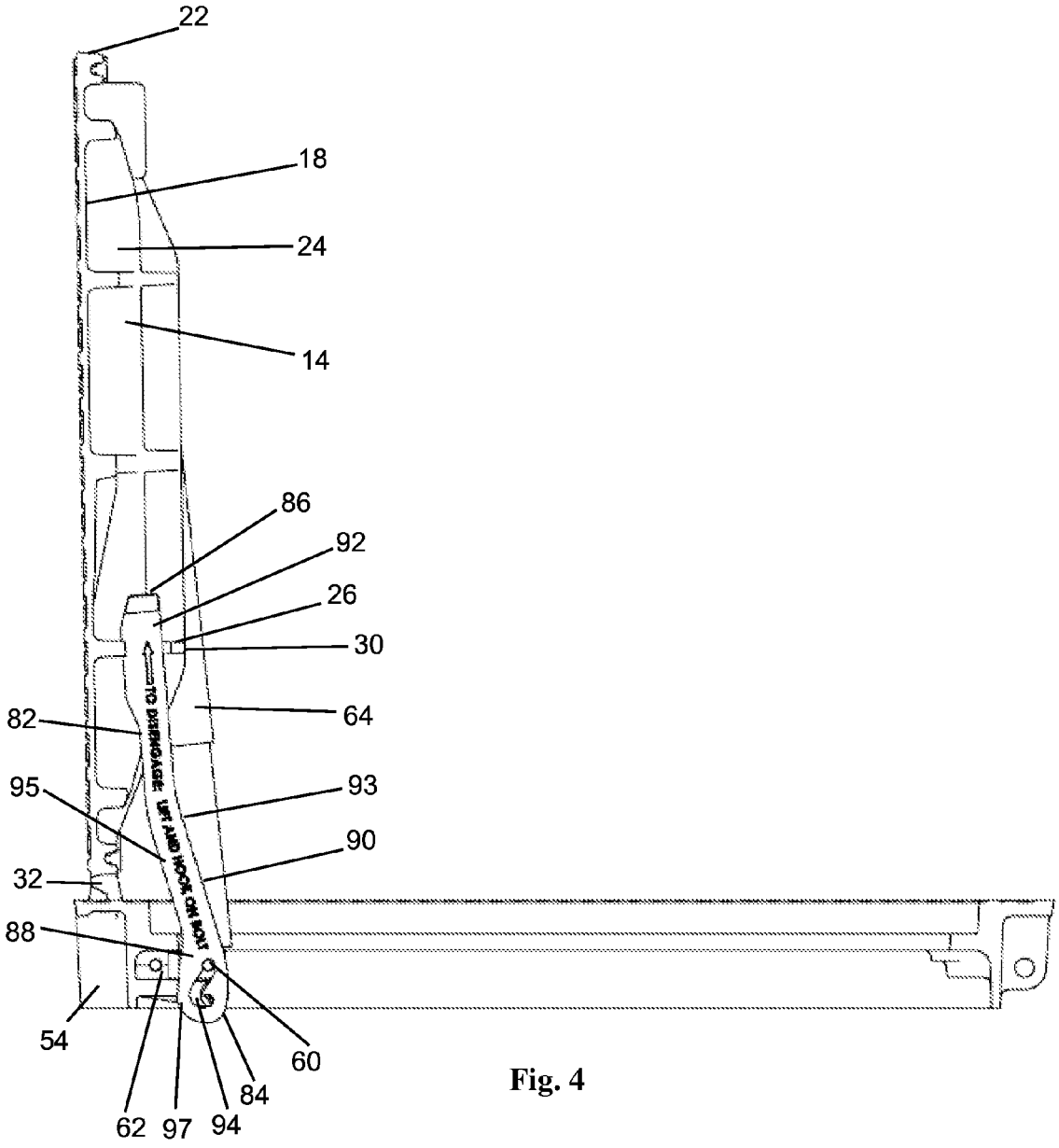
FIG. 4 is a side cross-sectional view of the manhole cover, wherein the cover is in a safety stop position.
Figure 5:
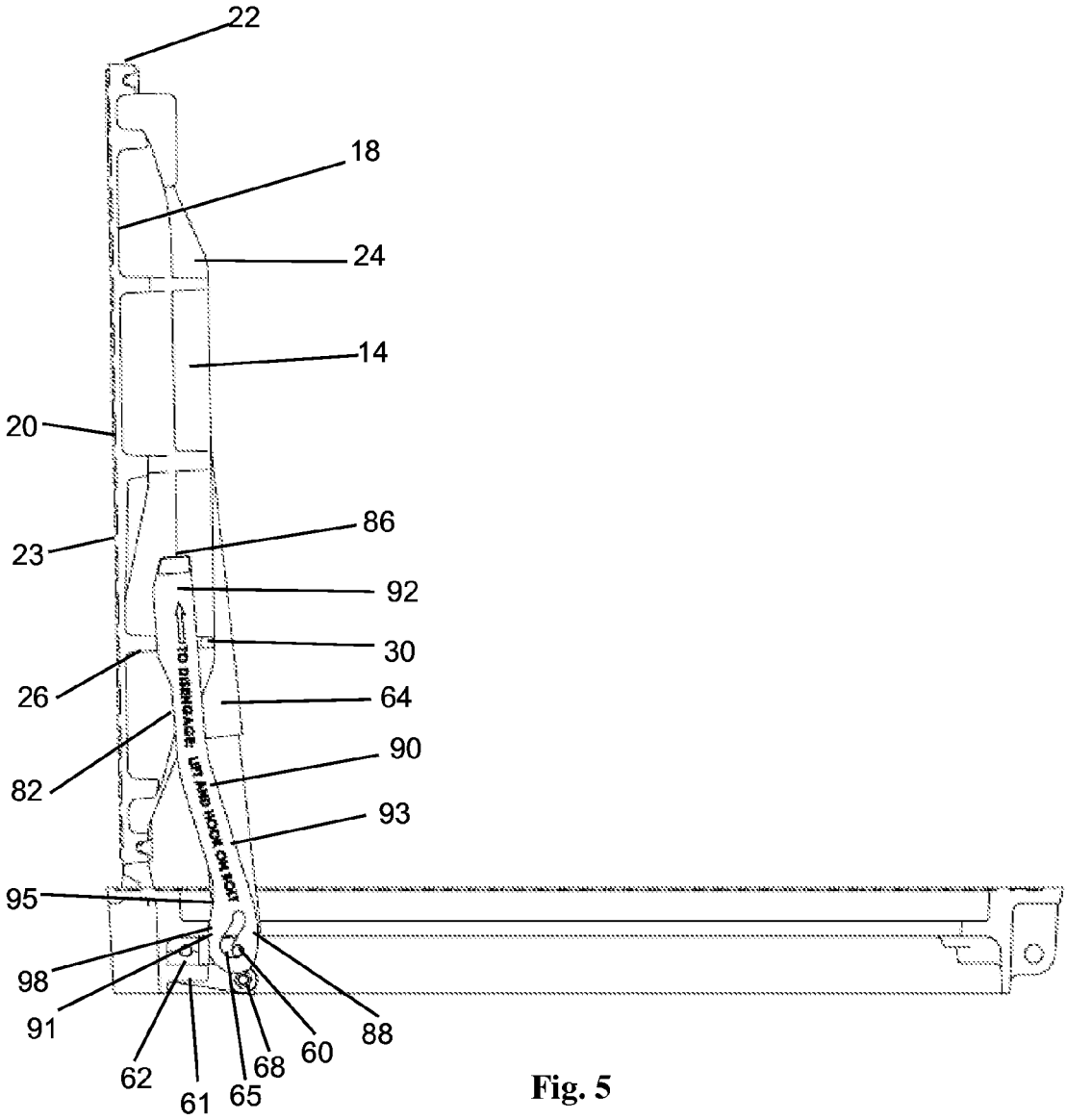
FIG. 5 is a side cross-sectional view of the manhole cover, wherein the safety device is disengaged.

The safety bar 82 is mounted to the frame 12 and the cover 14 in a manner that enables the safety bar 82 to move with respect to the cover 14 and frame 12 when the cover 14 is raised to the open position. As shown in FIG. 2, when the cover 14 is in the closed position, the safety pivot post 60 is positioned within the slot 94 at the junction between the elongated portion 98 and the hook portion 100. As the cover 14 is moved to a partially open position (as shown in FIG. 3) the safety bar 82 travels downwardly with respect to the safety pivot post 60, such that the post 60 moves into the elongated portion 98 of the slot 94. When the cover has moved to an open position, such as that shown in FIG. 4, the safety bar 82 is moved to the upper end 102 of the elongated portion 98 of the slot 94. In this position, also known as the "safety stop" position, the rear edge 95 of the safety bar 82 engages the leading edge 65 of the safety stop 61. More particularly, the generally flat edge 91 of the safety bar 82 engages the leading edge 65 of the safety stop 61, preventing the pivoting of the cover 14 to the closed position. FIG. 1 shows the cover 14 in a fully opened position with the safety bar 91 dropped, wherein the flat edge 91 is disengaged from the leading edge 65 of the safety stop 61. FIG. 5 shows the cover in the open position, with the safety bar 82 raised such that the post 60 is positioned within the hook portion 100 of the slot 94 at the end 105 of the hook portion 100. The safety bar 82 must be moved manually into this raised position. In this raised position, the flat edge 91 is disengaged from the safety stop 61, and the rounded corner 97 provides clearance between the safety stop 61 and the safety bar 82 that enables the cover 14 to be moved to the closed position. In the illustrated embodiment, the third portion 92 of the safety bar 82 extends through the retaining loop 26 on the cover 14. The retaining loop 26 permits the safety bar 82 to move back and forth through the retaining loop 26 as the cover is opened and closed and the safety bar 82 moves along the safety pivot post 60, while retaining the safety bar 82 such that it remains adjacent to the cover 14 and is prevented from falling into the central opening 36 of the frame 14.

The shape and positioning of the slot 94, the rear edge 95 of the safety bar 82, and the safety stop 61 may be varied in order to control the angle of the "safety stop" position. For instance, in the illustrated embodiment, the flat edge 91 on the safety bar, the positioning of the upper end 105 of the slot 94 close to the front edge 93 of the safety bar 82 and the location and angle of the leading edge 65 of the safety stop 61 cause the safety bar 82 to fall and prevent the cover from closing when the cover 14 is opened to about ninety degrees. In an alternative embodiment, the slot, rear edge of the safety bar, and the safety stop may have a different configuration that causes the cover to enter the "safety stop" status at an angle that is smaller or greater than ninety degrees.

III. Operation

In operation, the safety device 80 allows the cover to be moved from the closed position (FIG. 2) to the open position (FIGS. 3 and 4), and prevents movement of the cover 14 from the open position back to the closed position without manual operation of the safety device 80. As noted above, when the cover 14 is in a closed position, the safety bar 82 is positioned with the safety pivot post 60 at the base end 103. In one embodiment, the safety bar 82 naturally falls into this position due to gravity. As the cover 14 is opened (see the partially opened position in FIG. 3) and the elongated portion 98 of the slot 94 is shifted toward a vertical direction, the safety bar 82 tends to fall in a downward direction, such that the post 60 slides up into the elongated portion 98 of the slot 94. In this partially open position, the cover 14 can still be moved back to the closed position, because of the clearance between the safety stop 61 and the rounded corner 97 on the safety bar 82. When the cover 14 is moved to the vertical position shown in FIG. 4, the safety bar 82 falls—as a result of gravity—to the upper end 102 of the elongated portion 98. In this position, the generally flat surface 91 on the safety bar 82 engages the leading edge 65 of the safety stop 61, and the cover 14 is prevented from being moved closed (i.e., the "safety stop" position). The cover 14 may, however, be moved between the safety stop position and the fully opened position shown in FIG. 1. The lift assist mechanism 64, if installed, may reduce the force required to lift the cover to the open position.

In order to close the cover 14, a user may grasp a portion of the safety bar 82, and manually lift the safety bar 82 vertically (in the direction of the arrow shown on the safety bar), to move the safety bar 82 until the rear edge 95 of the safety bar 82 is disengaged from the safety stop 61, permitting the cover 14 to be moved to the closed position. The clearance between the safety stop 61 and the rounded corner 97 permits movement of the cover 14 back to the closed position. In one embodiment, the safety bar 82 is moved such that the safety pivot post 60 is positioned within the hook portion 100 of the slot 94. In particular, the safety bar 82 may be moved such that the post 60 is positioned at the end 105 of the hook portion 100. As a result of the angle of the hook portion 100 with respect to the elongated portion 98, the safety bar 82 is held in the disengaged position, and prevented from falling due to gravity when the post 60 is positioned in the hook portion 100 (see FIG. 5). After positioning the safety post 60 within the hook portion 100, the user may release the safety bar 82 and move the cover 14 closed.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to packages of any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A manhole cover assembly comprising:

a frame defining a central opening, said frame including a safety stop portion;

a cover hingedly attached to said frame such that said cover is pivotable between a closed position covering said central opening and an open position providing access to said central opening; and a safety device connected to said frame and said cover, wherein movement of said cover to said open position automatically moves said safety device to a locked position in which said safety device engages said safety stop portion and prevents movement of said cover to said closed position, wherein said safety device is manually movable when said cover is in said open position between said locked position and an unlocked position in which said safety device is disengaged from said safety stop and permits said cover to move to said closed position, wherein said frame includes a frame wall, and a post extending from said frame wall, said safety device defining a slot that receives said post, wherein said slot moves with respect to said post when said safety device is moved between said locked position and said unlocked position.

2. The manhole cover assembly of claim 1 wherein said safety stop portion projects inwardly from said frame wall.

3. The manhole cover assembly of claim 2 wherein said open position is approximately a 90 degree angle between said cover and said frame.

4. The manhole cover assembly of claim 2 wherein said slot includes a first portion and a second portion, said second portion extending at an angle from said first portion.

5. The manhole cover assembly of claim 4 wherein said post automatically translates within said first portion when said cover is moved from said closed position to said open position.

6. The manhole cover assembly of claim 5 wherein said manual movement of said safety device from said locked position to said unlocked position moves said post from said first portion of said slot to said second portion of said slot.

7. The manhole cover assembly of claim 6 wherein said safety device includes a front edge facing said access opening and a rear edge opposite said front edge, said rear edge engaging said safety stop portion when said safety device is in said locked position.

8. A safety device for a manhole cover assembly having a frame and a cover pivotally attached to the frame, the cover being movable between an open position and a closed position, the safety device comprising:

a pivot post extending from the frame;

a safety stop extending from the frame; and a safety bar defining a slot, said post extending into said slot, wherein said post is positioned at a first location within said slot when the cover is in the closed position and a second location within said slot when said cover is in said open position, said safety bar being disengaged from said safety stop when said post is in said first position, said safety bar engaged with said safety stop when said post is in said second position to prevent movement of said cover toward said closed position.

9. The safety device of claim 8 wherein said safety bar automatically moves when the cover is moved to the open position, said movement of said safety bar transferring said post from said first position to said second position.

10. The safety device of claim 9 wherein said safety bar can be manually moved when the cover is in the open position, said manual movement of said safety bar transferring said post from said second position to a third position within said slot, wherein said safety bar is disengaged from said safety stop when said post is in said third position to permit movement of the cover to the closed position.

11. The safety device of claim 10 wherein said slot includes an elongated section and a hook section extending at an angle from said elongated section, said first position and said second position of said post within said slot located within said elongated section, said third position located within said hook section.

12. The safety device of claim 11 wherein said safety bar includes a rear edge and a front edge, said rear edge engaging said safety stop when said post is in said second position.

13. The safety device of claim 12 wherein said elongated section of said slot extends at an angle with respect to said rear edge, such that said second position is closer to said rear edge than said first position.

14. The safety device of claim 13 wherein the frame includes a frame wall defining a central opening, and wherein said safety stop projects inwardly from said frame wall, said safety stop including a leading edge that engages said rear edge of said safety bar when said cover is open and said post is at said second location within said slot.

15. The safety device of claim 14 wherein said leading edge of said safety stop is angled with respect to said frame wall.

16. A manhole cover assembly comprising:

a frame including a frame wall defining an access opening, said frame wall including an exterior surface and an interior surface, a cover support rim extending from said interior surface, a safety stop extending from said interior surface, and an arm extending from said interior surface, said arm including a pivot post extending therefrom;

a cover hingedly attached to said frame such that said cover is movable between a closed position covering said access opening and an open position providing access to said access opening, said cover including an upper surface and a lower surface, said lower surface supported on said cover support rim when said cover is in said closed position, said cover including a safety bar retainer extending from said lower surface; and a safety bar including a front edge facing said access opening, a rear edge facing said cover, a first end and a second end opposite said first end, said safety bar defining a slot proximate said first end, said slot including an elongated section and a hook section extending at an angle from said elongated section, said slot receiving said pivot post such that said pivot post can translate within said slot, wherein said pivot post is positioned at a first position in said slot when said cover is in said closed position, wherein said safety bar automatically moves when said cover is moved to said open position, said automatic movement of said safety bar moving said post to a second position within said elongated section of said slot, said rear edge of said safety bar engaging said safety stop when said post is in said second position to prevent movement of said cover to said closed position, said safety bar capable of being manually moved when said cover is in said open position, said manual movement of said safety bar moving said post to a third position within said hook section of said slot, said safety bar disengaged from said safety stop when said post is in said third position to permit movement of said cover to said closed position.

17. The manhole cover assembly of claim 16 wherein said second end of said safety bar extends through said safety bar retainer.

18. The manhole cover assembly of claim 16 wherein elongated section of said slot includes an upper end and a base end, said base end located at a junction with said hook section, said base end being closer to said rear edge than said upper end.

19. The manhole cover assembly of claim 18 wherein first position of said post within said slot is located at said base end of said slot and said second position of said post within said slot is located at said upper end of said slot.

* * * * *